United States Patent [19]

Romijn

[11] Patent Number: 4,776,175

[45] Date of Patent: Oct. 11, 1988

[54] METHOD AND APPARATUS FOR THE AUTOMATIC PERIODICAL DISCHARGE OF NON-CONDENSABLE GASES FROM THE CIRCUIT OF A COMPRESSION REFRIGERATION MACHINE

[75] Inventor: Johannes G. Romijn, Vught, Netherlands

[73] Assignee: Grasso's Koninklijke Machinefabrieken N.V., Hertogenbosch, Netherlands

[21] Appl. No.: 86,738

[22] Filed: Aug. 19, 1987

[30] Foreign Application Priority Data

Aug. 19, 1986 [NL] Netherlands ..... 8602106

[51] Int. Cl.[4] ..... F25B 47/00

[52] U.S. Cl. ..... 62/85; 62/195; 62/231

[58] Field of Search ..... 62/85, 195, 475, 231, 62/228.3, 158

[56] References Cited

U.S. PATENT DOCUMENTS 1,744,816 11/1936 Troup .
2,400,620 1/1945 Zwickl .
3,131,548 5/1964 Chubb et al. .
3,145,544 8/1964 Weller ..... 62/195
3,167,928 2/1965 Swearingen .
4,169,356 10/1979 Kingham ..... 62/85
4,304,102 12/1981 Gray ..... 62/195

FOREIGN PATENT DOCUMENTS 101674 1/1962 Netherlands .
390294 7/1965 Sweden .
492939 8/1970 Sweden .

*Primary Examiner*—William E. Wayner
*Attorney, Agent, or Firm*—Cushman, Darby & Cushman

[57] ABSTRACT

Method and apparatus of discharging non-condensable gases from the circuit of a compression refrigeration machine, wherein a part of the circuit through which there is no flow is indirectly cooled by a smaller secondary refrigeration machine in order to condense the condensable refrigerant vapor in that part and thus to lower the content of non-condensable gases to be discharged in that part, whereby the value of the suction pressure of the refrigerant circuit of the secondary refrigerating machine is used for automatically starting and stopping the discharge of non-condensable gases.

8 Claims, 1 Drawing Sheet

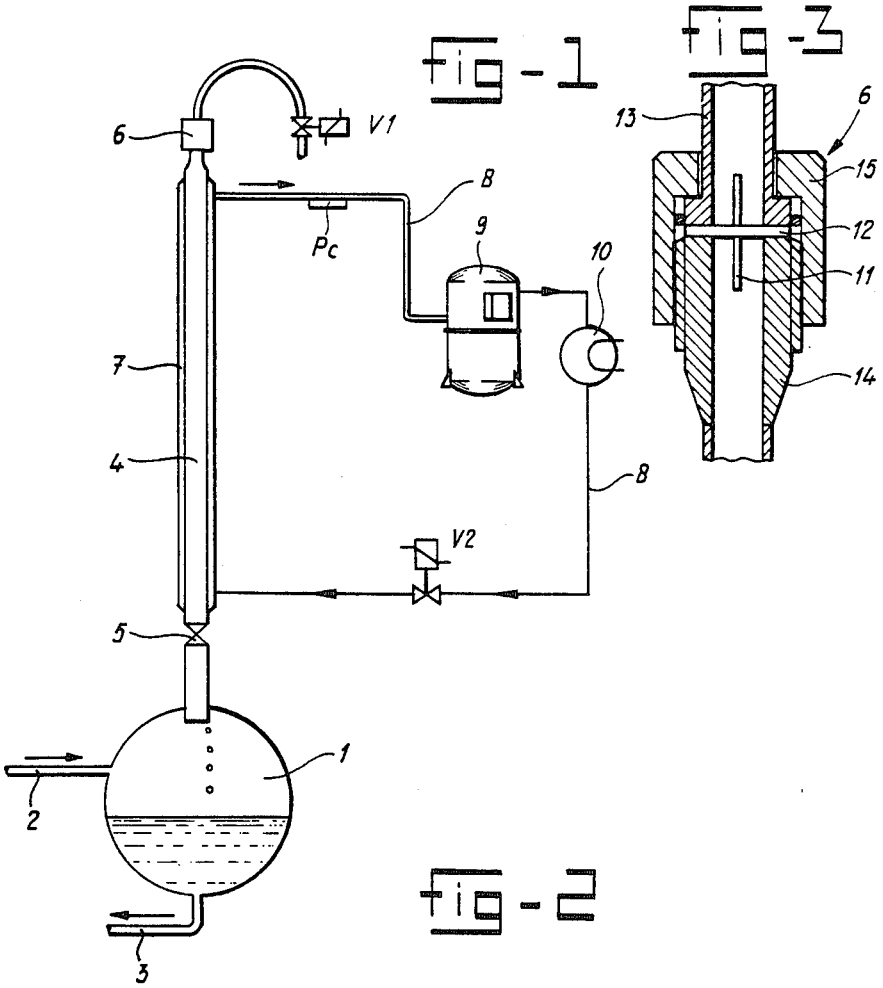
fig-1
fig-3
6
V1
B
Pc
9
10
7
4
8
V2
5
1
2
3
13
15
12
11
14
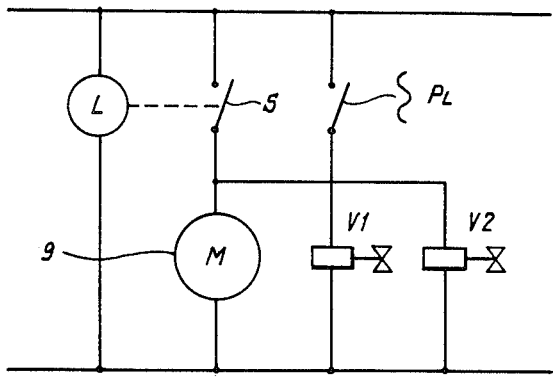
fig-2
L
S
PL
9
M
V1
V2

METHOD AND APPARATUS FOR THE AUTOMATIC PERIODICAL DISCHARGE ON NON-CONDENSABLE GASES FROM THE CIRCUIT OF A COMPRESSION REFRIGERATION MACHINE

The invention relates to a method of discharging non-condensable gases from the circuit of a compression refrigeration machine, wherein a part of the circuit through which there is no flow is indirectly cooled by a smaller secondary refrigeration machine in order to condense the condensable refrigerant vapour in that part and thus to increase the content of non-condensable gases to be discharged in that part, and further relates to an apparatus for applying said method.

A method and an apparatus of this kind are known from U.S. Pat. No. 4,169,356.

Cooling with the aid of a secondary refrigeration machine prevents the loss of a large amount of refrigerant from the circuit of the primary refrigeration machine, since the refrigerant is to a substantial extent condensed.

Nevertheless, a great deal of refrigerant is lost during blowoff. When the refrigerant consists of ammonia, this is not so objectionable in respect of cost, but it is certainly undesirable for the environment. Environmental objections are even greater where freon is concerned, while in addition the question of cost is also important. The price of freon is about eight times that of ammonia, and its density is at least six times as high.

In the known method the blowoff is either continuous, or the commencement and end of the blowoff must be determined by the operator, who has no information regarding the ratio of condensable to non-condensable gases.

The U.S. Pat. No. 4,169,356 does not in fact state how to control the process. The plant fails when the non-condensable gas content in the primary refrigerant circuit falls sharply, as is the intention. With a falling content of non-condensable gas a current of pure primary refrigerant will be offered at saturation temperature, which is from 0° to 20° K. above ambient temperature. The auxiliary refrigeration machine will not be able to condense this flow at low temperature. The temperature in the refrigeration coils of the auxiliary refrigeration machine will rise, and in the extreme case will even rise to the saturation temperature of the primary refrigerant, because the transfer of heat from the primary to the secondary refrigerant can take place with a very low temperature differential with practically pure vapour. In the deaeration part the primary refrigerant will therefore practically retain its saturation pressure at ambient temperature. Practically pure refrigerant then escapes through the blowoff, which is precisely what must be avoided. The auxiliary refrigeration machine will also probably break down under the overload.

The invention seeks to improve the known method and this is achieved in that the value of the suction pressure of the refrigerant circuit of the secondary refrigeration machine is used for automatically starting and stopping the discharge of non-condensable gases.

The value of the suction pressure in the secondary circuit is directly related to the content of non-condensable gases in the primary circuit. A high content of non-condensable gases, such as air, indicates in fact poor indirect transfer of heat between the two circuits. The temperature in the secondary circuit and thus also the pressure in that circuit thus fall. In other words, because of the poor transfer of heat the secondary refrigeration machine can easily discharge the heat flow offered and will thus be able to lower the temperature of the secondary refrigerant.

If on the other hand the content of non-condensable gases in the primary refrigerant is low, practically only pure primary refrigerant is in heat exchange relationship with the secondary refrigerant and the transfer of heat between the two refrigerants is very good. The secondary refrigeration machine can then deal with the heat flow offered only with a smaller temperature differential and therefore at higher temperature and pressure of the secondary refrigerant.

There is then a threat of overloading of the secondary refrigeration machine. The suction pressure in the secondary circuit then rises above a predetermined value, so that the secondary refrigeration machine is switched off and blowoff from the primary circuit is stopped. According to the invention this consequently takes place entirely automatically. The discharge of non-condensable gases also takes place according to the invention in a metered manner, that is to say for a determined pressure the discharge capacity is fixed.

The invention also relates to an apparatus for applying the method.

The invention will now be explained more fully with reference to the drawings, in which:

FIG. 1 is a schematic representation of the deaeration apparatus according to the invention;

FIG. 2 is an electric diagram for the operation of the apparatus, and

FIG. 3 is a cross-section of the metering blowoff apparatus.

In FIG. 1, 1 designates a receiver vessel containing liquid refrigerant and gas. The gas consists of vaporous refrigerant and non-condensable gases, such as air.

The apparatus according to the invention seeks to remove these non-condensable gases periodically without losing an amount of refrigerant which is excessive from the economic point of view.

A pipe 2, coming from the condenser (not shown) of the refrigeration machine requiring deaeration, is connected to the top of the receiver vessel. The expression "deaeration" is thus used to mean not solely the removal of air, but also that of other non-condensable gases.

A pipe 3, which leads to the evaporator (likewise not shown) of the refrigeration machine, is connected to the bottom of the receiver vessel 1.

A vertical pipe 4 is also connected to the top of the vessel 1 and is provided with a shut-off valve 5 between the vessel 1 and the pipe 4, a metering blowoff device 6, which will be discussed later on, and a shut-off valve V1. This pipe 4 is thus not part of the circuit, although it is connected to it.

The pipe 4 is surrounded by a jacket 7, through which refrigerant from a smaller secondary refrigeration machine is passed. This secondary refrigeration machine consists of a pipe 8, a compressor 9, a condenser 10 and an operable expansion shut-off valve V2. The jacket 7 forms the evaporator.

Between the evaporator 7 and the compressor 9 is disposed a pressure gauge Pc, which operates a switch $P_L$ in dependence on the suction pressure in the pipe 8 (see FIG. 2).

FIG. 2 shows the electrical diagram of the apparatus according to FIG. 1. L designates therein a time clock adapted to operate a switch 5. M designates the motor of the compressor 9.

When S is closed, the compressor 9 is in operation and the shut-off valves V1 and V2 are opened.

This is also the case when S is opened but Pc closes the secondary circuit, by means of the switch $P_L$, under a determined pressure in the pipe 8.

The apparatus shown in FIG. 1 works as follows:

The time clock L is set so that after for example 24 hours it closes the switch S and keeps it closed during a certain period of time, for example for five minutes. During this time Pc measures the suction pressure in the pipe 8 upstream of the compressor 9.

This suction pressure is a measure of the content of condensable gas and the content of non-condensable gas in the tube 4. Condensable gas is formed by the refrigerant, such as freon or ammonia, and must as far as possible be retained.

With a high air content in the pipe 4 the transfer of heat between the jacket 7 and the tube 4 is poor and the secondary refrigeration machine is well able to cool the tube 4 adequately.

The suction pressure in the pipe 8 upstream of the compressor 9 is then low. When the sensor Pc measures a suction pressure below a predetermined value, the switch $P_L$ is closed by Pc. The compressor 9 then continues to operate and the switches $V_1$ and $V_2$ remain open, despite the fact that the time clock L interrupts the switch S after five minutes.

In view of the fact that $V_1$ is open, non-condensable gas is blown off to the atmosphere during this time until the content of non-condensable gas in the pipe 4 has fallen to such an extent that the transfer of heat between 7 and 4 is once again satisfactory. The suction pressure in the pipe 8 then rises above a determined adjusted value, and Pc switches off $P_L$, so that the secondary refrigeration machine is stopped and $V_1$ is also closed. The blowoff is thus stopped until the time clock L switches on again.

If during the aforesaid period of five minutes it is already found that the air content in the tube 4 is low, the suction pressure in the pipe 8 will be high and Pc will switch off the switch $P_L$. At the end of the period of five minutes L will also switch off S, so that the secondary refrigeration machine will stop.

The apparatus according to the invention stops and the blowoff process thus starts automatically in dependence on the content of non-condensable gases.

The known apparatus blows off continuously, or else blowoff must be stopped or started manually. However in this case no information at all regarding the air content in the tube 4 is available. The only known method is to connect to $V_1$ a bottle filled with water. If bubbles are seen to rise to the surface of the water, this means that air is contained in the pipe 4, but there is no indication of the amount of air.

In the case of the apparatus according to the invention the suction pressure in the pipe 8 is a measure of the air content in the pipe 4. It had never been realized that use could be made of it.

In the apparatus according to the invention, moreover, blowoff is effected in a metered manner, and the blowoff valve 6 can for this purpose be constructed as illustrated in FIG. 3. The passage of the blowoff valve 6 is formed by a small tube 11 of stainless steel having, for example, an inside diameter of 0.05 mm and an outside diameter of 0.3 mm. The length of the tube 11 determines the blowoff capacity. With a pressure of for example 10 bars, 5 cubic centimeters of air per second, for example, are blown off. The user of the apparatus according to the invention thus knows accurately how much air is blown off during the blowoff operation.

The slender, vulnerable tube 11 can be mounted in a plate 12 clamped in the pipe parts 13 and 14 by means of a coupling nut 15.

I claim:

1. A method of discharging non-condensable gases from the primary circuit portion of a fluid and gas refrigeration circuit through which there is no flow and which is indirectly cooled by a smaller secondary refrigeration machine in order to condense the condensable refrigerant vapor in said portion and thus to lower the content of non-condensable gasses to be discharged from said portion, characterized in that the discharge of non-condensable gasses and the operation of said secondary refrigeration machine is initiated for a predetermined time interval and the value of the suction pressure of the refrigerant circuit of said secondary refrigeration machine is used for automatically stopping the discharge of non-condensable gasses after the passage of said predetermined time interval.

2. Method according to claim 1, characterized in that a timer mechanism with intervals of at least several hours puts the secondary refrigeration machine into opertion and keeps it in operation for a short time of a few minutes, and thereby at the same time starts and stops the discharge of non-condensable gasses from the primary circuit, unless during said short time the suction pressure in the secondary circuit falls below a first determined value, said low suction pressure triggering a pressure sensor which continues the operation of the secondary refrigeration machine until said suction pressure rises above a second predetermined level.

3. Method according to claim 1, characterized in that the discharge of non-condensable gases from the primary circuit is effected at a determined pressure with a fixed capacity.

4. Apparatus for discharging non-condensable gasses from a portion of a primary refrigeration circuit wherein there is no flow of refrigerant, and which is provided with a closable blowoff opening, comprising:

a secondary refrigeration circuit in indirect thermal contact with said primary circuit, characterized in that the suction pipe of said secondary circuit incorporates a pressure sensor adapted to switch off the secondary refrigeration machine and close the blowoff opening when a predetermined suction pressure is exceeded after said secondary circuit has operated for a predetermined length of time.

5. Apparatus according to claim 4, characterized in that a timer mechanism is connected in parallel with said pressure sensor and is adapted to switch on the secondary refrigeration machine and to open the blowoff opening at desired intervals.

6. A method according to claim 2, characterized in that the intervals are of order of 24 hours and the short times of operation are on the order of 5 minutes.

7. Appratus according to claim 4, characterized in that the blowoff opening comprises a small tube.

8. Apparatus according to claim 7, characterized in that the inside diameter of the small tube amounts to about 0.05 millimeters.

* * * * *